US010486849B2

(12) United States Patent
Parkes

(10) Patent No.: US 10,486,849 B2
(45) Date of Patent: Nov. 26, 2019

(54) RE-CLOSEABLE CARTON DEVICE

(71) Applicant: Avery Dennison Corporation, Mentor, OH (US)

(72) Inventor: Garry Parkes, Maidenhead (GB)

(73) Assignee: AVERY DENNISON CORPORATION, Glendale, CA (US)

( * ) Notice: Subject to any disclaimer, the term of this patent is extended or adjusted under 35 U.S.C. 154(b) by 0 days.

(21) Appl. No.: 14/518,410

(22) Filed: Oct. 20, 2014

(65) Prior Publication Data

US 2017/0008664 A1 Jan. 12, 2017

Related U.S. Application Data

(60) Provisional application No. 61/954,285, filed on Mar. 17, 2014.

(51) Int. Cl.

| | |
|---|---|
| ***B65D 5/66*** | (2006.01) |
| ***B65D 5/20*** | (2006.01) |
| ***B65D 5/26*** | (2006.01) |

(52) U.S. Cl.

CPC ..... *B65D 5/26* (2013.01); *B65D 5/6667* (2013.01)

(58) Field of Classification Search

CPC ..... B65D 5/26; B65D 5/6667; B65D 5/22; B65D 5/6655; B65D 5/2057; B65D 5/6658

USPC ..... 229/148, 125.26

See application file for complete search history.

(56) References Cited

U.S. PATENT DOCUMENTS

| | | | | |
|---|---|---|---|---|
| 5,040,722 | A * | 8/1991 | Fromion | B65D 5/6667 229/117.17 |
| 5,161,734 | A * | 11/1992 | Ruehl | B65D 5/5415 229/147 |
| 5,515,996 | A * | 5/1996 | Stone | B65D 5/5425 229/122.32 |
| 6,484,928 | B1 * | 11/2002 | Hoefte | B65D 5/548 229/120.21 |
| 8,875,878 | B2 * | 11/2014 | Young | B65D 5/6691 206/268 |
| 2003/0222130 | A1 * | 12/2003 | Fukushima | B65D 5/6608 229/145 |
| 2004/0060974 | A1 * | 4/2004 | Dacey | B65D 5/543 229/225 |

* cited by examiner

*Primary Examiner* — Christopher R Demeree
(74) *Attorney, Agent, or Firm* — Avery Dennison Retail Information Services, LLC

(57) ABSTRACT

A re-closable carton device is disclosed for transporting footwear and other articles. The re-closable carton device comprises a pair of opposing side panels, a base panel joined to the side panels and having a pair of opposing side flanges, and a lid closure side panel hingedly attached to the rear side panel. The lid closure side panel comprises female recess areas which engage with the male locking tabs of the front side panel. Specifically, the male locking tabs engage the female recess areas such that the male locking tabs partially enter the female recess areas and press against the female recess areas to distort the front flap of the lid closure side panel and to produce an audible sound or "click" when the carton device is fully closed to alert a user that the carton device has been reclosed adequately.

11 Claims, 3 Drawing Sheets

RE-CLOSEABLE CARTON DEVICE

CROSS-REFERENCE TO RELATED APPLICATION

The present application claims the benefit of U.S. Provisional Application No. 61/954,285 filed on Mar. 17, 2014, which is incorporated herein by reference in its entirety.

BACKGROUND

The present invention relates generally to cartons for use in shipping a plurality of articles. In a variety of consumer packaging applications, it is important to have cardboard containers, cartons or the like which are capable of conveniently, yet securely being opened and reclosed repeatedly. However, conventional re-closeable cartons tend to be restrictive in their use in certain consumer packaging applications because of their lack of a positive locking arrangement in combination with a carton design that is conducive to repeated open and close operations. Typically, conventional re-closeable cartons utilize a friction-fit design. However, the friction-fit designs have been found to be unacceptable because of the distinct possibility of the lid opening by itself. Further, such friction-fit designs lack some form of positive indication, either tactile or audible, that an opened carton has been reclosed adequately. Thus, there is a need for a re-closable carton that is conducive to repeated open and close operations, and that comprises some form of positive indication that an opened carton has been reclosed adequately.

The present invention discloses a re-closeable carton device that is robust enough to endure multiple openings and closings without either being damaged or causing damage to the carton itself. Further, the re-closeable carton device produces a distinctive sound or "click" when the carton is fully closed to alert a user that the carton has been reclosed adequately. The audible sound is produced by the interaction of the male locking tabs and the female recess areas. Thus, the re-closeable carton device allows users to repeatedly open and close the carton without damage, and alerts the users when the carton has been reclosed adequately, by producing an audible "click".

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a re-closable carton device for transporting footwear and other articles. The re-closable carton device comprises a pair of opposing side panels, a base panel joined to the side panels and having a pair of opposing side flanges, and a lid closure side panel hingedly attached to the rear side panel. The lid closure side panel comprises female recess areas which engage with the male locking tabs of the front side panel. Specifically, the male locking tabs engage the female recess areas and force the front flap of the lid closure side panel to distort when the carton device is adequately closed. When the carton device is opened, the front flap returns to its normal shape.

In a preferred embodiment, the male locking tabs engage the female recess areas such that the male locking tabs partially enter the female recess areas and press against the female recess areas to produce an audible sound or "click" when the carton device is fully closed to alert a user that the carton device has been reclosed adequately. The male locking tabs pressing against the female recess areas also act to distort the front flap of the lid closure side panel when the carton device is adequately closed.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
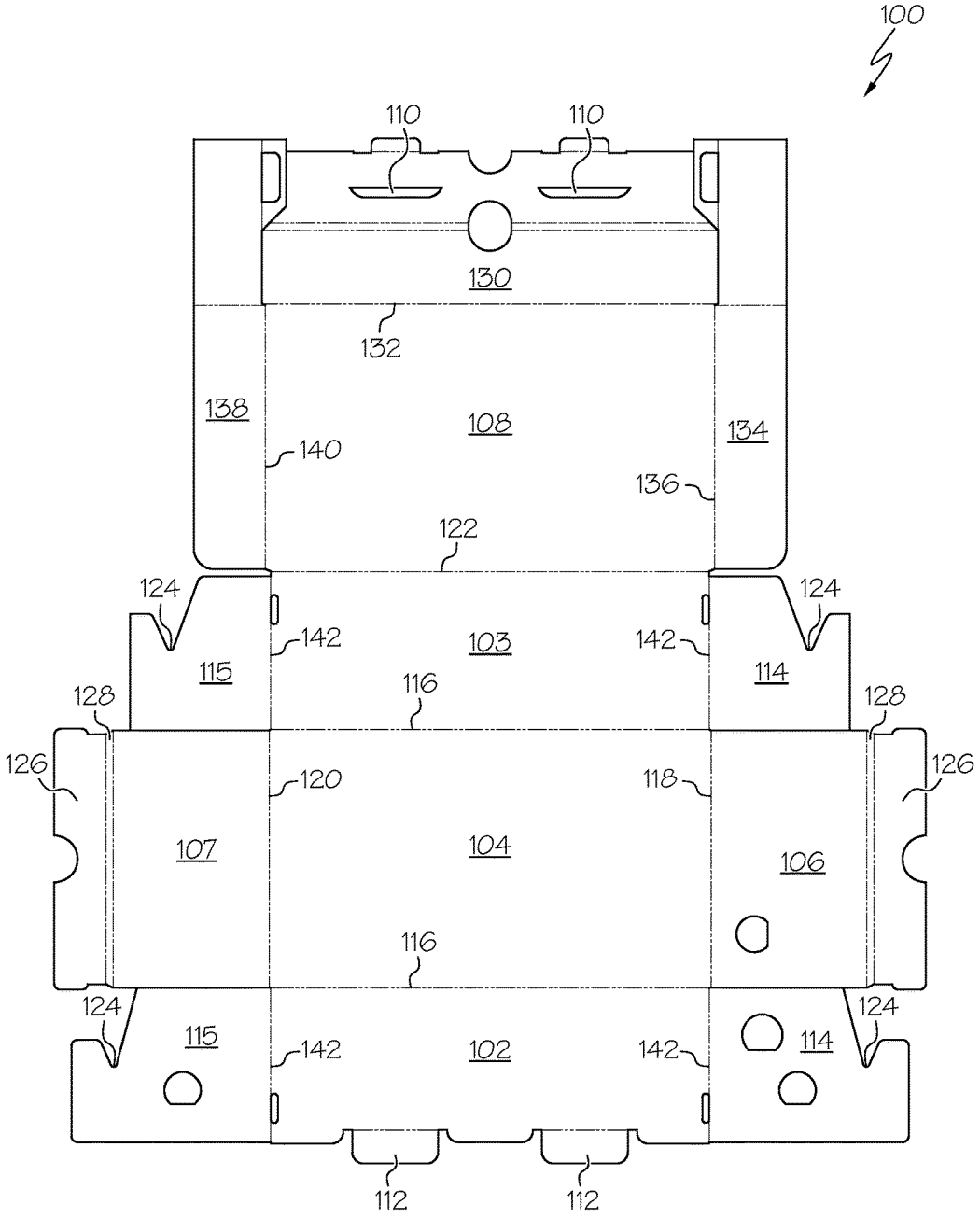
FIG. 1 illustrates a plan view of the carton blank for the re-closeable carton device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention discloses a re-closeable carton device that is robust enough to endure multiple openings and closings without either being damaged or causing damage to the carton itself. Further, the re-closeable carton device produces a distinctive sound or "click" when the carton is fully closed to alert a user that the carton has been reclosed adequately. The audible sound is produced by the interaction of the male locking tabs and the female recess areas. Thus, the re-closeable carton device allows users to repeatedly open and close the carton without damage, and alerts the users when the carton has been reclosed adequately, by producing an audible "click".

The re-closable carton device comprises a pair of opposing side panels, a base panel joined to the side panels and having a pair of opposing side flanges, and a lid closure side panel hingedly attached to the rear side panel. The lid closure side panel comprises female recess areas which engage with the male locking tabs of the front side panel. Specifically, the male locking tabs engage the female recess areas such that the male locking tabs partially enter the female recess areas and press against the female recess areas to distort the front flap of the lid closure side panel and to produce an audible sound or "click" when the carton device is fully closed to alert a user that the carton device has been reclosed adequately.

Referring initially to the drawings, FIG. 1 illustrates a re-closeable carton device (blank) 100 for transporting footwear and other articles. The re-closeable carton device 100 may be formed from a unitary carton blank (as shown in FIG. 1), such as a unitary corrugated paperboard blank that is suitably cut, scored, perforated, etc. to be folded into re-closeable carton device 100. It is understood that other suitable materials, such as corrugated plastic, may also be used for these blanks. As described in detail below, the blank of the present invention can be formed into the re-closeable carton device 100, via folding along the cut, scored, or perforated lines to form a hollow rectangular body. It should be noted that the preferred embodiment of the present invention, whether in its initial blank form or converted into the carton for shipping is represented generally by reference numeral 100.

Figure 2:
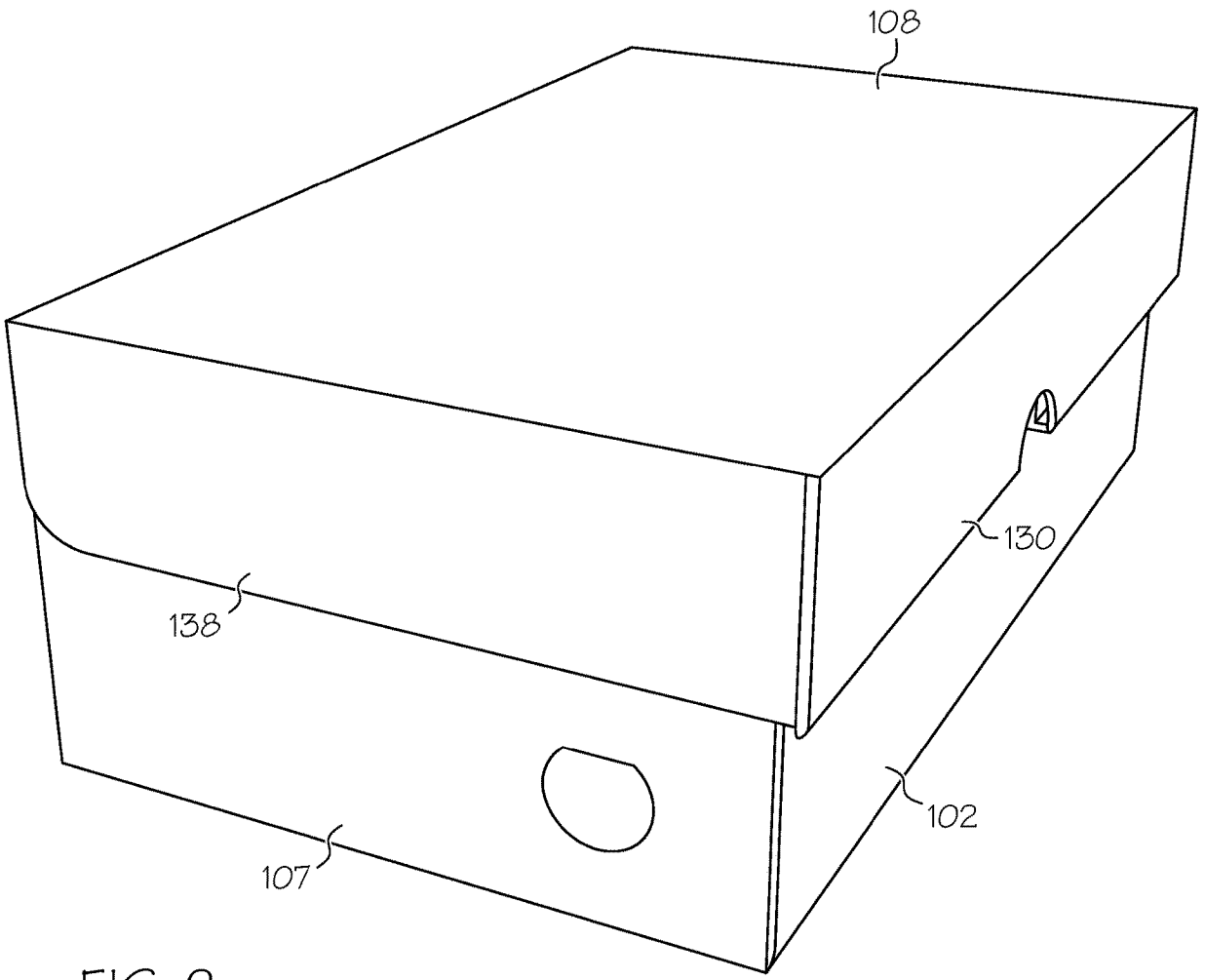
FIG. 2 illustrates a perspective view of the re-closeable carton device formed from the carton blank in accordance with the disclosed architecture.

The re-closable carton device (blank) 100 comprises a pair of opposing side panels 102 and 103, a base panel 104 joined to the side panels 102 and 103 and having a pair of opposing side flanges 106 and 107, and a lid closure side panel 108 hingedly attached to the rear side panel 103. The base panel 104 is generally rectangular in shape and is hingedly connected to the side panels 102 and 103 via scorelines 116. Right side flange 106 is generally rectangular in shape and is hingedly connected to base panel 104 by a scoreline 118. Left side flange 107 is identical in size and shape to right side flange 106 and is hingedly connected to base panel 104 by a scoreline 120. Lid closure side panel 108 is identical in size and shape to base panel 104 and is hingedly connected to rear side panel 103 via scoreline 122. Thus, scorelines 116 and 122 are disposed in parallel relationship relative to each other to adapt blank 100 to be folded into the re-closeable carton device 100 of the present invention (as shown in FIG. 2).

The side panels 102 and 103 each comprise a pair of end panel locking tabs 114 and 115 which act to secure the sides of the re-closeable carton device 100 together. Specifically, each end panel locking tab 114 and 115 comprises a notch 124 which acts to engage with corresponding notch 124 of the opposing end panel locking tab 114 and 115. The notches 124 overlap, interlocking the end panel locking tabs 114 and 115 together. Further, a generally rectangular flap 126 hingedly connected to side flanges 106 and 107 via scorelines 128 is folded over the interlocking end panel locking tabs 114 and 115 to secure the end panel locking tabs 114 and 115 together.

Furthermore, the front side panel 102 comprises male locking tabs 112 that protrude out from the front side panel 102 at approximately a 45 degree angle. Additionally, the lid closure side panel 108 comprises a generally rectangular front flap 130 hingedly connected to the lid closure side panel 108 via scoreline 132, a right side flap 134 connected to the lid closure side panel 108 via scoreline 136 and a left side flap 138 connected to the lid closure side panel 108 via scoreline 140. Generally rectangular front flap 130 is shaped to define female recess areas 110 or elongated slots which engage with the male locking tabs 112 of the front side panel 102 and can together serve to close the carton device 100.

Specifically, the male locking tabs 112 engage the female recess areas 110 and force the front flap 130 of the lid closure side panel 108 to distort when the carton device 100 is adequately closed. When the carton device 100 is opened, the front flap 130 of the lid closure side panel 108 returns to its normal shape. Specifically, the male locking tabs 112 engage the female recess areas 110 such that the male locking tabs 112 partially enter the female recess areas 110 and press against the female recess areas 110 to produce an audible sound or "click" when the re-closeable carton device 100 is fully closed to alert a user that the re-closeable carton device 100 has been reclosed adequately.

Figure 3:
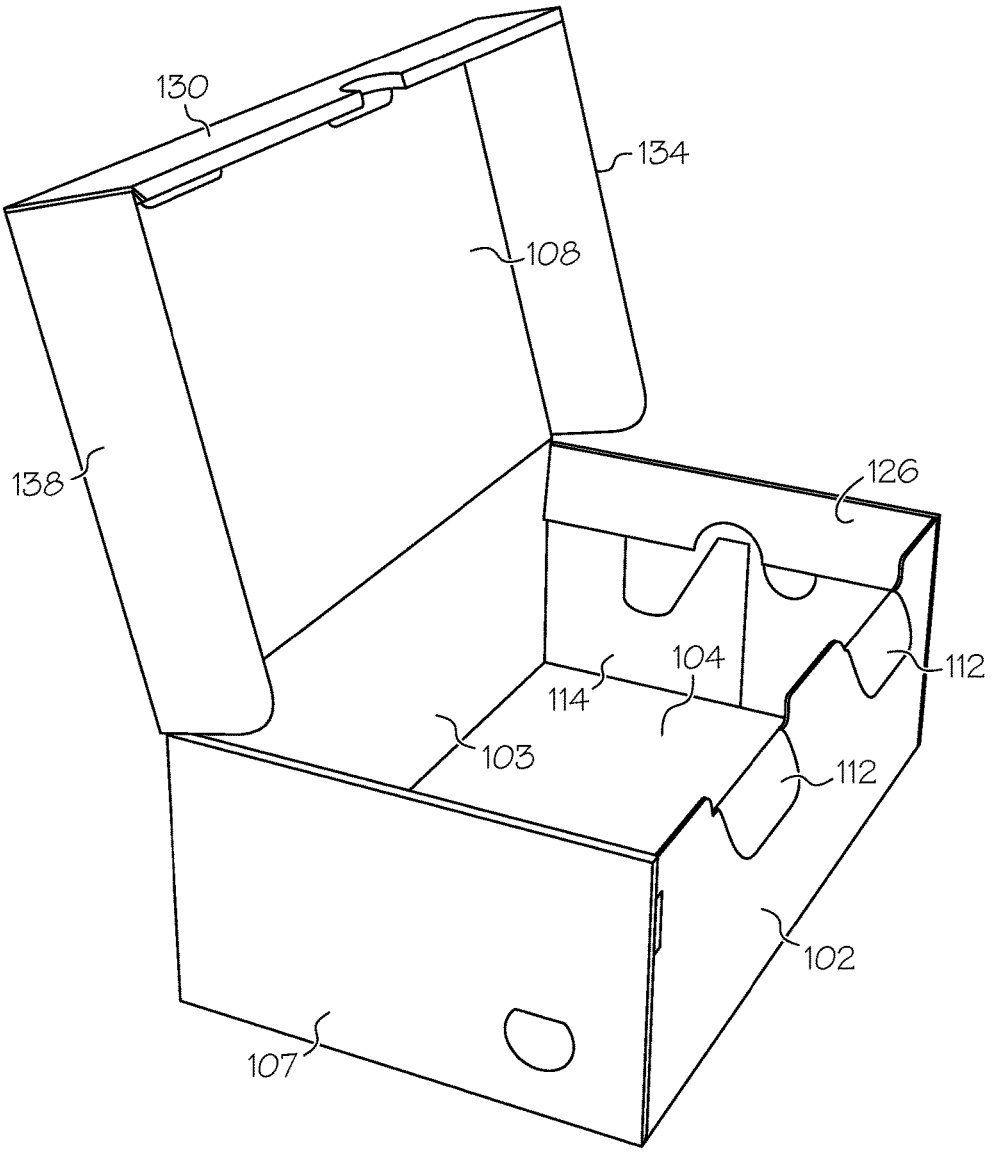
FIG. 3 illustrates a perspective view of the re-closeable carton device formed from the carton blank with the lid open in accordance with the disclosed architecture.

FIGS. 2-3 illustrate the re-closeable carton device 100 formed from the blank 100. Specifically, the blank 100 can be formed into the re-closeable carton device 100 for shipping in the following manner. Left side flange 107 and right side flange 106 are folded up through scorelines 120 and 118, respectively, so as to extend perpendicular relative to the base panel 104. Front side panel 102 and rear side panel 103 are folded up through scorelines 116, so as to extend parallel relative to the base panel 104, and male locking tabs 112 are folded out from front side panel 102.

The end panel locking tabs 114 and 115 are folded through scorelines 142, and notches 124 engage each other overlapping and interlocking the end panel locking tabs 114 and 115 together. Further, the generally rectangular flap 126 of side panels 102 and 103 is folded through scorelines 128 over the interlocking end panel locking tabs 114 and 115 to secure the end panel locking tabs 114 and 115 together. The lid closure side panel 108 is then folded through scoreline 122 and the generally rectangular front flap 130 is folded through scoreline 132 to define the female recess areas 110. Additionally, right side flap 134 is folded through scoreline 136 and left side flap 138 is folded through scoreline 140 to form the four-sided box-shape configuration of re-closeable carton device 100 (as shown in FIG. 3).

Once, the blank 100 is folded into the box-shape configuration, the re-closeable carton device 100 can be loaded with the particular articles to be shipped. After the particular articles have been loaded into the re-closeable carton device 100, the re-closeable carton device 100 can be folded closed by pressing the lid closure side panel 108 down onto the side flanges 106 and 107 toward the base panel 104, until the female recess areas 110 engage with the male locking tabs 112 of the front side panel 102 to force the front flap 130 of the lid closure side panel 108 to distort and to produce an audible sound or "click" when the re-closeable carton device 100 is fully closed (as shown in FIG. 2). Thus, the audible sound or "click" alerts a user that the re-closeable carton device 100 has been reclosed adequately.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A re-closeable carton device for use in the shipping of a plurality of articles, said carton device being formed from a single-piece corrugated paperboard blank, said carton device, comprising:

a pair of opposing front and rear side panels;

male locking tabs secured to the front side panel;

a base panel joined to the front and rear side panels and comprising a pair of opposing right and left side flanges;

overlapping notches interlocking end panel locking tabs together; and a lid closure side panel hingedly attached to the rear side panel;

wherein the lid closure side panel comprises a front flap hingedly connected to the lid closure side panel, the front flap defining female recess areas which engage with the male locking tabs of the front side panel to press against the female recess areas to distort the front flap of the lid closure side panel and the lid closure side panel is pressed down onto the right and left side flanges to produce an audible sound when the re-closeable carton device has been reclosed adequately.

2. The re-closeable carton device of claim 1, where the plurality of articles is footwear.

3. The re-closeable carton device of claim 1, where the base panel is generally rectangular in shape.

4. The re-closeable carton device of claim 1, where the lid closure side panel comprises a generally rectangular front flap hingedly connected to the lid closure side panel via scoreline.

5. The re-closeable carton device of claim 1, where a right side flap is connected to the lid closure side panel via scoreline and a left side flap is connected to the lid closure side panel via scoreline.

6. A blank for forming a re-closeable carton device, said blank being formed from a single-piece of corrugated paperboard, said blank being cut and scored to comprise:

a pair of opposing front and rear side panels where the front side panel comprises male locking tabs that protrude out from the front side panel at approximately a 45 degree angle when the blank has been formed into a re-closable carton device;

a base panel joined to the front and rear side panels and having a pair of opposing right and left side flanges; and overlapping notches interlocking end panel locking tabs together; and a lid closure side panel hingedly attached to the rear side panel;

wherein the lid closure side panel includes a front flap hingedly connected to the lid closure side panel, the front flap defining female recess areas which engage with the male locking tabs of the front side panel to distort the front flap of the lid closure side panel and to produce an audible, click sound when the blank has been formed into a re-closable carton device and the re-closeable carton device has been closed.

7. The blank for forming a re-closeable carton device of claim 6, where the blank can be folded along cut, scored, or perforated lines to form a hollow rectangular body.

8. A blank for forming a re-closeable carton device, said blank being formed from a single-piece of corrugated material and comprising:

a pair of opposing front and rear side panels where the front side panel comprises male locking tabs that protrude out from the front side panel at approximately a 45 degree angle when the blank has been formed into a re-closable carton device;

a base panel joined to the front and rear side panels and having a pair of opposing right and left side flanges; and overlapping notches interlocking end panel locking tabs together; and a lid closure side panel hingedly attached to the rear side panel;

wherein the lid closure side panel includes a front flap hingedly connected to the lid closure side panel, the front flap defining female recess areas which engage with the male locking tabs of the front side panel to distort the front flap of the lid closure side panel to produce an audible, click sound when the blank has been formed into a re-closable carton device and the re-closeable carton device has been closed.

9. The blank for forming a re-closeable carton device of claim 8, where the unitary corrugated material is suitably cut, scored, or perforated.

10. The blank for forming a re-closeable carton device of claim 9, where the material is corrugated paperboard or corrugated plastic.

11. The blank for forming a re-closable carton device of claim 8, where the female recess areas are elongated slots.

* * * * *